US011655082B2

(12) United States Patent
Cecchi et al.

(10) Patent No.: US 11,655,082 B2
(45) Date of Patent: May 23, 2023

(54) CONTAINER WITH SAFETY-LATCH

(71) Applicants: Michael D. Cecchi, Longboat Key, FL (US); Paige E. Cecchi, Longboat Key, FL (US)

(72) Inventors: Michael D. Cecchi, Longboat Key, FL (US); Paige E. Cecchi, Longboat Key, FL (US)

( * ) Notice: Subject to any disclaimer, the term of this patent is extended or adjusted under 35 U.S.C. 154(b) by 530 days.

(21) Appl. No.: 16/749,300

(22) Filed: Jan. 22, 2020

(65) Prior Publication Data

US 2021/0221577 A1 Jul. 22, 2021

(51) Int. Cl.

| | |
|---|---|
| ***B65D 50/04*** | (2006.01) |
| ***E05C 19/14*** | (2006.01) |
| ***B65D 55/04*** | (2006.01) |
| ***E05B 65/00*** | (2006.01) |
| ***E05C 19/16*** | (2006.01) |

(52) U.S. Cl.

CPC ..... *B65D 50/046* (2013.01); *B65D 55/04* (2013.01); *E05B 65/0014* (2013.01); *E05C 19/14* (2013.01); *E05C 19/16* (2013.01)

(58) Field of Classification Search

CPC ..... B65D 50/00–048; B65D 50/046; B65D 45/24; B65D 45/04; B65D 45/02; B65D 45/22; B65D 45/16; B65D 2215/04; B65D 2313/04; B65D 55/04; B65D 50/06–067; E05C 19/08; E05C 19/14; E05C 19/16; E05C 19/066; E05C 19/06; E05C 19/063; E05B 65/0014; E05B 65/52; E05B 17/2053

USPC ..... 292/256, 210; 215/201, 216; 220/324

See application file for complete search history.

(56) References Cited

U.S. PATENT DOCUMENTS

| | | | | | |
|---|---|---|---|---|---|
| 484,235 | A * | 10/1892 | Plunkett | E05C 19/14 | 292/DIG. 20 |
| 2,951,722 | A * | 9/1960 | Swanson | E05C 19/14 | 292/247 |
| 3,703,975 | A * | 11/1972 | Wittemer | G11C 11/40 | 220/212.5 |
| 3,936,082 | A * | 2/1976 | Swanson | E05C 19/14 | 292/DIG. 31 |
| 4,307,906 | A * | 12/1981 | Schenk | E05C 19/14 | 292/1 |
| 4,705,308 | A * | 11/1987 | Bisbing | E05C 19/14 | 292/108 |
| 4,917,421 | A * | 4/1990 | Wightman | E05C 19/14 | 292/DIG. 53 |
| 5,385,257 | A * | 1/1995 | Hung | B65D 45/24 | 220/849 |
| 5,462,318 | A * | 10/1995 | Cooke | E05C 19/14 | 292/113 |
| 6,629,335 | B1 * | 10/2003 | Derman | E05F 5/06 | 292/DIG. 60 |

(Continued)

*Primary Examiner* — Kristina R Fulton
*Assistant Examiner* — Emily G. Brown
(74) *Attorney, Agent, or Firm* — Michael A. Blake

(57) ABSTRACT

A container with a safety-latch, the container comprising: a lid; a base rotatably attached to the lid; a lip located on the lid; a base pin attached to the base; an outer sleeve rotatably attached to the base pin; a U-shaped pin rotatably attached to the outer sleeve, and configured to removably attach to the lip; where the outer sleeve and U-shaped pin are difficult for a child to manipulate in order to remove the U-shaped pin from the lip.

4 Claims, 7 Drawing Sheets

(56) References Cited

U.S. PATENT DOCUMENTS

| | | | | |
|---|---|---|---|---|
| 6,840,551 | B2 * | 1/2005 | Evans | E05C 19/14 292/336.3 |
| 8,186,728 | B2 * | 5/2012 | Kopylov | E05C 19/14 292/113 |
| 9,938,757 | B2 * | 4/2018 | Raffi | E05C 19/188 |
| 2004/0007595 | A1 * | 1/2004 | Stull | B65D 47/0838 222/153.14 |
| 2004/0187270 | A1 * | 9/2004 | Lee | A44B 11/25 24/191 |
| 2014/0208710 | A1 * | 7/2014 | Roth | A01D 34/733 56/255 |

* cited by examiner

CONTAINER WITH SAFETY-LATCH

TECHNICAL FIELD

The present invention relates to a container, and more particularly to a container with a safety-latch.

BACKGROUND

Adults may want to keep items away from children. The items may be dangerous to children. Such items may include medicines, cannabinoid products, including cannabis, and other items. Some safety latches are used in industry, but they can be expensive, difficult to operate by adults, and may be aesthetically unappealing.

Thus there is a need for a container with a safety-latch that overcome the above listed and other disadvantages.

SUMMARY OF THE INVENTION

The disclosed invention relates to a container with a safety-latch, the container comprising: a lid; a base rotatably attached to the lid; a lip located on the lid; a base pin attached to the base; an outer sleeve rotatably attached to the base pin; a U-shaped pin rotatably attached to the outer sleeve, and configured to removably attach to the lip; where the outer sleeve and U-shaped pin are difficult for a child to manipulate in order to remove the U-shaped pin from the lip.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

Figure 1:
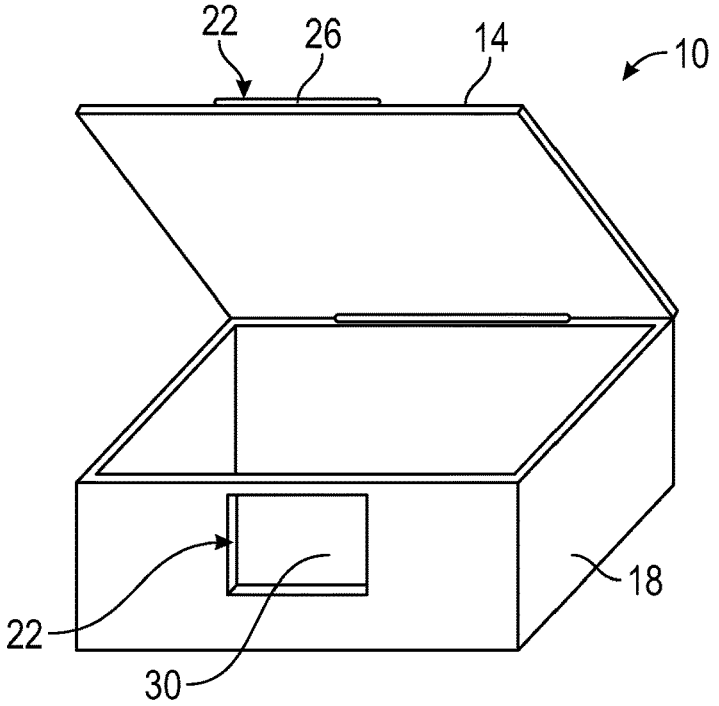
FIG. 1 is a front view of the container with a safety-latch.

FIG. 1 is a perspective view of a container 10 with a lid 14 and a base 18. A safety-latch 22 comprises catch plate 26 and an anchor plate 30.

Figure 2:
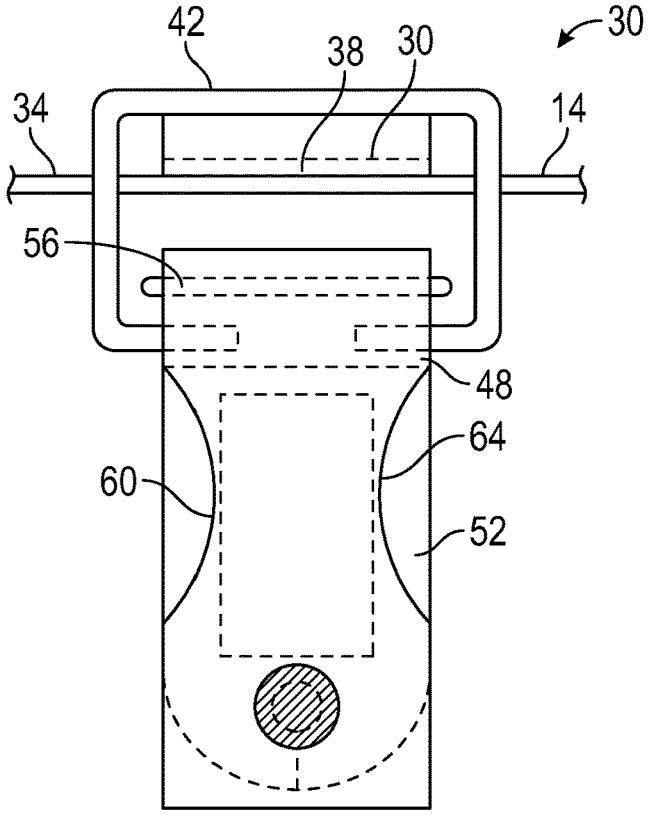
FIG. 2 is a front view of the safety-latch.

FIG. 2 is a close up view of the anchor plate 30. The lid 14 is shown with the catch plate 26 along the outer side 34 of the lid 14. In one embodiment, the catch plate 26 comprises a lip 38 configured to allow a U-shaped pin 42 to removable attach to the lip 38 and close the lid 14 with respect to the base 18. The anchor plate 30 is rotatably attached to the U-shaped pin 42. The anchor plate 30 also is rotatably attached to the base 18. In one embodiment, the anchor plate 30 may rotate about a base pin 56 that is attached to the base 18. The anchor plate 30 comprises an outer sleeve 48. Located within the outer sleeve 48 is an inner member 52 that is elastically deformable, wherein when the inner member is deformed by a user, it will go back to its original shape once the deforming force is removed. The outer sleeve 48 has a first side cutout 60 and a second side cutout 64 that allows a user to squeeze the inner member 52. The inner member 52 may be made out of any suitable material with elastic properties, including, but not limited to quartz fiber, elastomers, natural rubber, synthetic rubber, nitrile rubber, silicone rubber, urethane rubbers, chloroprene rubber, Ethylene Vinyl Acetate (EVA rubber), etc.

Figure 3:
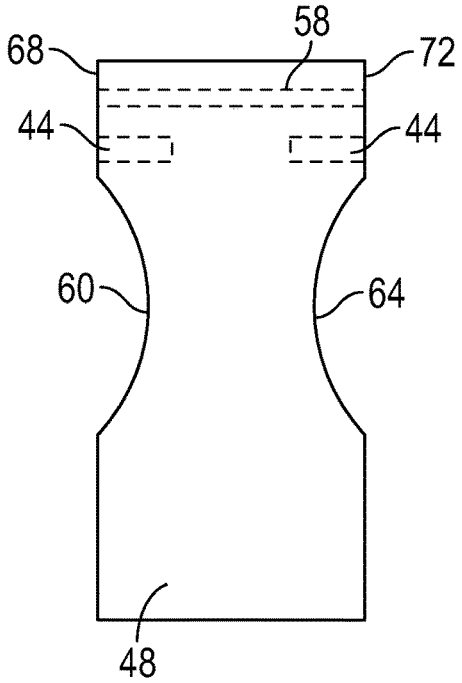
FIG. 3 is a front view of the outer sleeve.

FIG. 3 shows the outer sleeve 48 removed from the base 18 and with the inner member 52 removed. A base pin hole 58 is shown in dashed lines on the sleeve 48. The base pin hole 58 is may be a through hole from the left side 68 of the outer sleeve 48 to the right side 72 of the outer sleeve 48. Also, the U-shaped pin holes 44, 45 are also shown in dashed lines. The U-shaped pin hole 44 may be a hole in the left side 68 of the outer sleeve 48 and only extends part way through the outer sleeve 48. Similarly, the U-shaped pin hole 45 may be a hole in the right side 78 that only extends part way through the outer sleeve 48.

Figure 4:
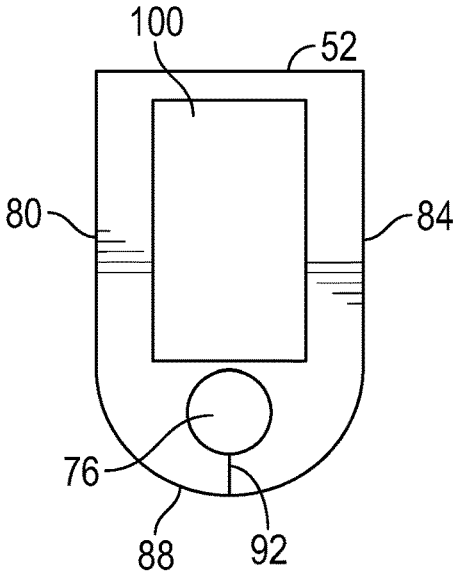
FIG. 4 is a front view of the inner member.
Figure 5:
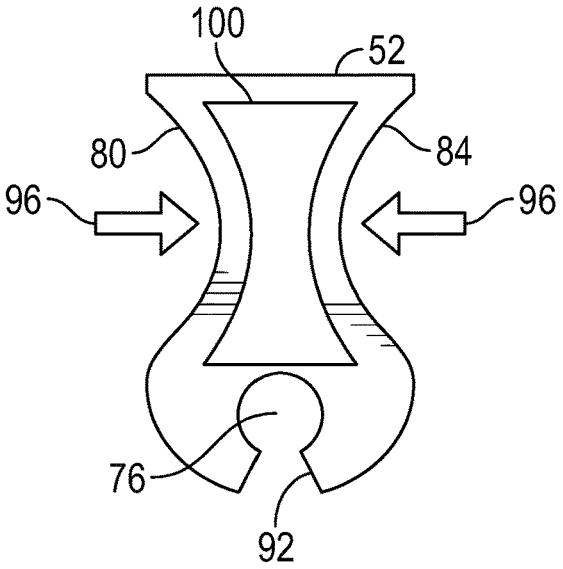
FIG. 5 is a front view of the inner member from FIG. 4 elastically deformed.

FIG. 4 is a view of the inner member 52. The inner member 52 is configured to fit within and/or slide within the outer sleeve 48. The inner member has a post hole 76. The post hole 76 is configured to contain a post located on the base 18. Between the post hole 76 and the bottom 88 of the inner member 52 is a cut 92. The inner member 52 is configured such that when the left side 80 and right side 84 of the inner member 52 are squeezed towards each other (see FIG. 5), the cut opens or spreads as shown in FIG. 5, so that the post hole 76 opens and the inner member 52 can slide up and away from a post that previously was located in the post hole 76 and the post was previously generally holding the inner member 52 in place relative to the post. The inner member 52 may have an opening 100 that helps the inner member 52 to elastically deform such that the cut 92 opens widely, as shown in FIG. 5. In another embodiment, the cut 92 may be omitted, and the post hole 76 is configured to snuggly slide over the post 104.

FIG. 5 is a front view of the inner member 52 being squeezed on its left and right sides 80, 84; the squeezing force is represented by the arrows 96. The squeezing force 96 elastically deforms the inner member 52 such that the cut 92 is forced open, thus opening the post hole 76.

Figure 6:
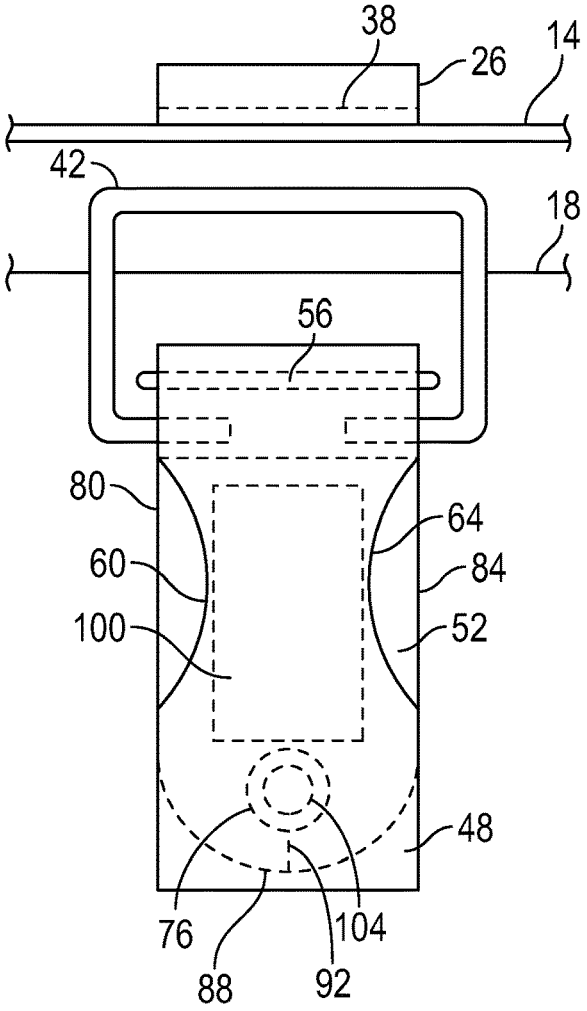
FIG. 6 is a front view of the lid and base and U-shaped pin.

FIG. 6 shows a front view of the lid and base. In this view, the inner member 52 is located within the outer sleeve 48. Portions of the U-shaped pin 42, and base pin 56 are shown in dashed line because they are behind the outer sleeve 48. In this view, the post 104 extending from the base 18 is shown in the post hole 76, and both are in dashed lines because they are behind the outer sleeve 48.

Figure 7:
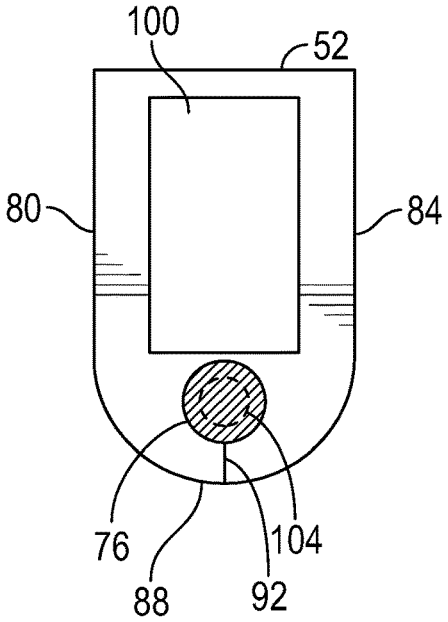
FIG. 7 is a front view of the inner member with the post in the post hole.

FIG. 7 is a view of the inner member 52 with a post 104 located in the post hole 76. The outer sleeve 48 and container 10 are removed for simplicity.

Figure 8:
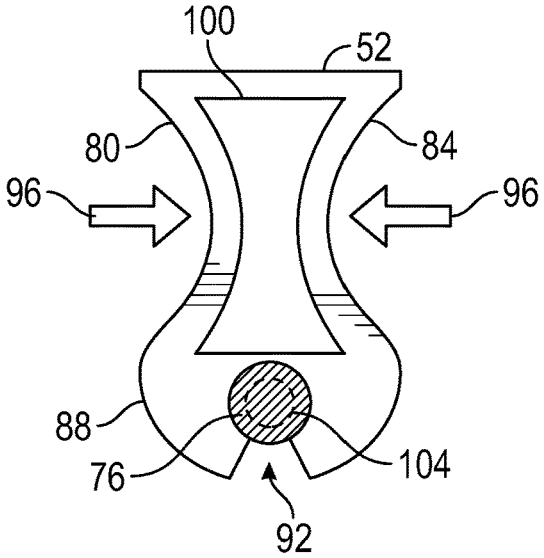
FIG. 8 is a front view of the inner member from FIG. 7 elastically deformed.

FIG. 8 is view of the inner member 52 with a post 104 located in the post hole 76. The outer sleeve 48 and container 10 are removed for simplicity. In this view the left side 80 and right side 84 are squeezed, causing the inner member 52 to elastically deform such that the cut 92 spreads open, thus allowing the post hole 76 to have an opening between the post hole 76 and the bottom 88 of the inner member 52 such that the inner member 52 can slide up and away from the post 104.

Figure 9:
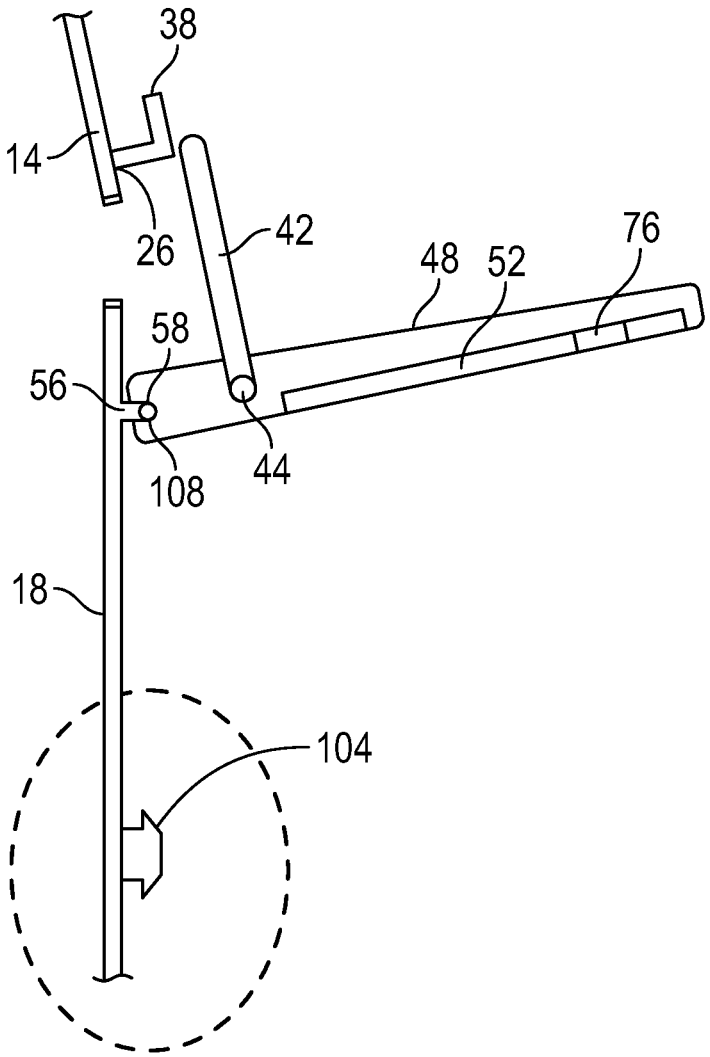
FIG. 9 is a side view of the lid and base and latching mechanism.

FIG. 9 is a side view of the lid 14 and base 18. The outer sleeve 52 can be seen able to rotate about the base pin 56. The base pin 56 is connected to the base 18. The outer sleeve 52 rotates about the pivot point 108 where the base pin is rotatably attached to the outer sleeve 52. The post 104 is shown attached to the base 18. When the outer sleeve 52 rotates towards the post 104, the post hole 76 will not fit over the post 104, unless the left side of inner member 80 and right side of inner member 84 are squeezed to elastically deform the inner member so the post hole 76 will become large to fit over the post 104. Once the squeezing force is removed from the left side of inner member 80 and right side of inner member 84, the post hole 76 will go back to its smaller size and fit snugly against the post 104. The lid 14 will be locked down on the based 18 because the u-shaped pin 42 will be holding the lid 14 down via the lip 38. In order to open the lid 14, a complex set of moves will need to be performed: (a) the left side of inner member 80 and right side of inner member 84 will need to be squeezed together; (b) the outer sleeve 48 and inner member 52 will need to be rotated up and away from the post 104 while maintaining the squeezing force on the left side of inner member 80 and right side of inner member 84; (c) rotate the outer sleeve 48 until the U-shaped pin 42 is no longer laying in the lip 38; (d) open the lid. These near simultaneous steps will be difficult for a child to perform, thus making the latch child-proof and thus providing a safe way to store items in the container 10

Figure 10:
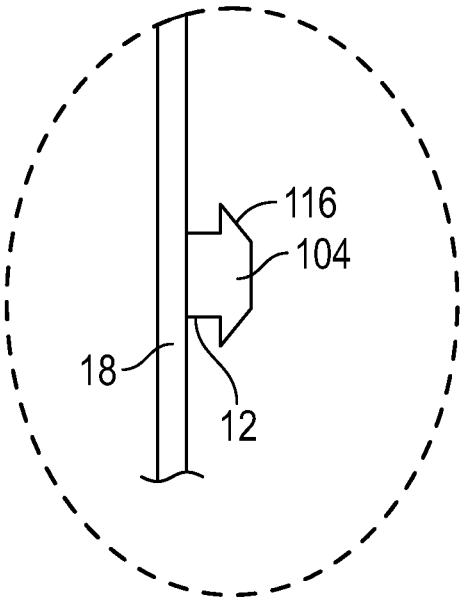
FIG. 10 is a detail view of the post.

FIG. 10 is a close up view of the post 104 from FIG. 9. The post 104 comprises a shaft 112, and a head 116 located at one end of the shaft 112. The shaft 112 may have a diameter slightly smaller than the post hole 76 diameter. The head 116 may have a diameter larger than the post hole 76 diameter. In one embodiment, the head 116 may taper from a diameter larger than the post hole 76 (on an end nearest the base 18) diameter, down to a diameter about the same as the post hole 75 diameter (on an end farthest from the base).

Figure 11:
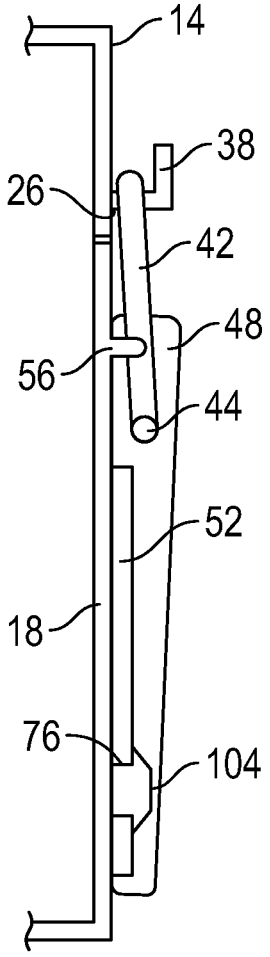
FIG. 11 is a side view of the lid and base and latching mechanism latched.

FIG. 11 is side view of the outer sleeve 52 from FIG. 9, where the latch system has closed the lid 14 with respect to the base 18, and the post 104 is inside of the post hole 76 of the inner member 52.

Figure 12:
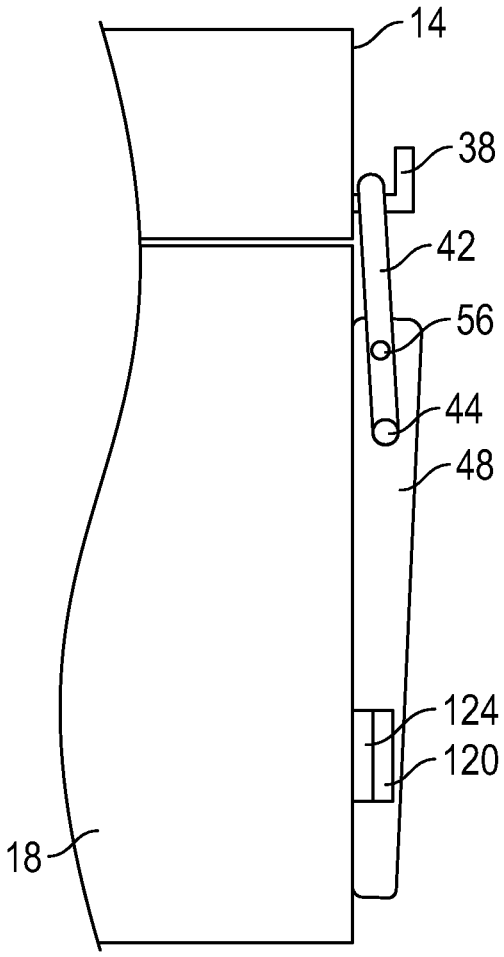
FIG. 12 is a magnet embodiment of the latching mechanism.

FIG. 12 is another embodiment of the safety-latch. In this embodiment, the outer sleeve 48 may be removably attached to the base 18 via magnetization means. The magnetization means may comprise a magnet 120 located on the sleeve 48 that is configured to magnetically attach to a magnet 124 attached to the base 18. In other embodiments, the magnet 124 may simply be a material that is attracted to magnets, such as a ferromagnetic material or diamagnetic material. In still other embodiments, a magnet 124 may be attached to the base, and a material 120 attracted to magnets may be attached to the sleeve 48.

Figure 13:
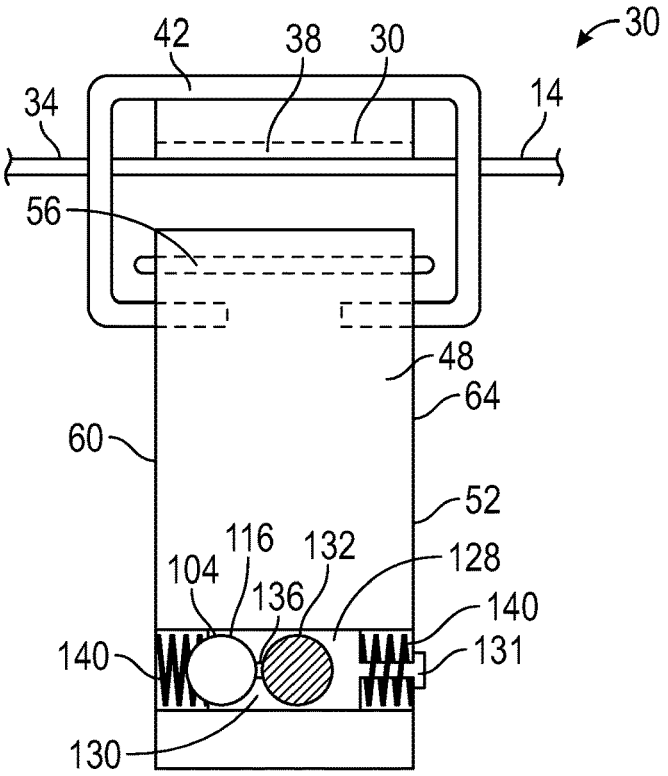
FIG. 13 is a post and sliding member embodiment of the latching mechanism.

FIG. 13 shows another embodiment of the safety-latch. In this embodiment, the base has a post 104 similar to the post shown in FIG. 10. Located within the outer sleeve 48 is a spring loaded locking mechanism 128. The spring loaded locking member comprises a sliding member 130. The sliding member comprises a hole 132 that is slightly larger than the diameter of the head 116 of the post 104, and a slot 136 that is slightly wider than the diameter of the shaft 112 of the post 104. Springs 140 maybe located on one or both sides of the sliding member. A push member 131 may be extend from the sliding member, and is configured to allow a user to push the sliding member 130. The springs 140 may be offset from the sliding member 140 so that a user can push the sliding member 130 on its push member 131 such that the hole 132 aligns with the head 116 of the post 104 so that the safety-latch is free to slide off of the post, and the lid 14 can be opened with respect to the base 18.

Figure 14:
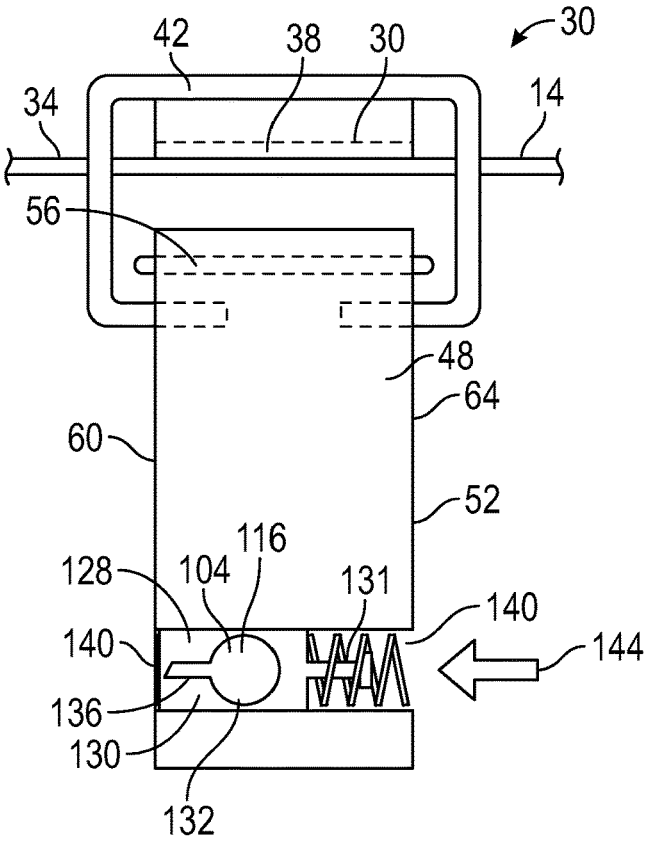
FIG. 14 is a view of the latching mechanism form FIG. 13, with the sliding mechanism pushed to the left.

FIG. 14 shows the sliding member 130 pushed by force 144 to the left, so that the hole 132 is aligned with the head 116 of the post 104, so that now the latch is unlocked, and the lid 14 can be released with respect to the base 118, and/or the lid 114 can be locked with respect to the base 118.

Figure 15:
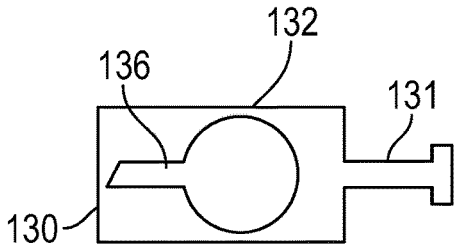
FIG. 15 is a detail view of the sliding member.

FIG. 15 is a close up view of the sliding member 130.

Figure 16:
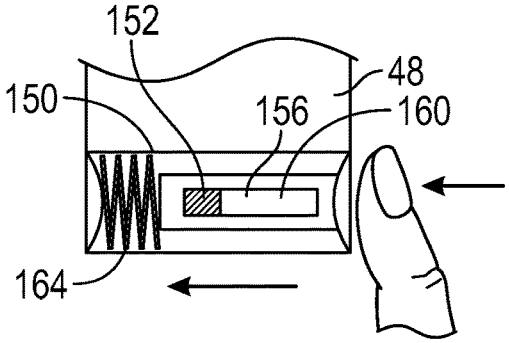
FIG. 16 is a locking tooth embodiment of the latching mechanism.

FIG. 16 shows another embodiment of the safety-latch. The safety-latch may comprise a spring loaded locking mechanism 150. The spring loaded locking mechanism 150 comprises a locking member 152 that extends from the base 18 (instead of a post 104). The spring loaded locking mechanism 150 comprises a sliding member 156, and a spring 164. The sliding member comprises a slot 160. The spring 164 is configured to push the sliding member against the locking member 152 so that the outer sleeve 48 is held against the base 14. When a user applies a force to the right of sliding member 156, the sliding member moves to the right, and the locking member 152 is released, and the outer sleeve 48 can be moved up and away from the base 14.

Figure 17:
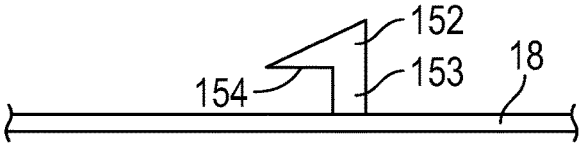
FIG. 17 is bottom view of the locking member from FIG. 16.

FIG. 17 shows a bottom view of the locking member 152 extending from the base 18. The locking member 152 may comprise an orthogonal section 153, that is orthogonal to the surface of the base 18. On a distal end of the orthogonal section 153 is a locking tooth 154 that is orthogonal to the orthogonal section 153. The locking tooth 154 will generally abut the sliding member 156, unless it is moved by the user so that it is aligned with the slot 160, and can then allow the outer sleeve 48 to rotate away from the base 18.

Figure 18:
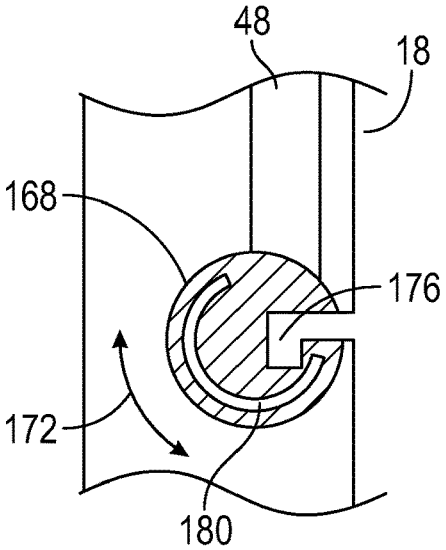
FIG. 18 is a side view of a torsional spring embodiment of the latching mechanism.
Figure 19:
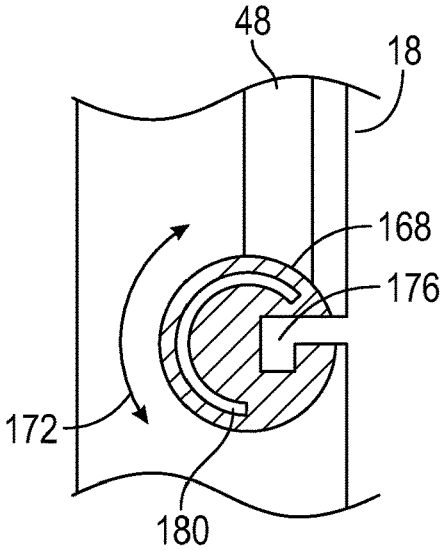
FIG. 19 is a side view of the latching mechanism from FIG. 18, with the latching mechanism in an unlatched configuration.

FIG. 18 is another embodiment of the safety latch. FIG. 18 is a side view cross-sectional view of the outer sleeve 48 and base 18. In this embodiment, the outer sleeve 48 comprises a rotatable member 168, which can rotate in the direction of the arrow 172. Extending from the base 18 is a locking member 176. Inside the rotatable member 168 is a torsional spring 180 configured to apply a force to the rotatable member in the counter-clockwise direction. In order to unlock the safety latch, a user must turn the rotatable in a clockwise direction, in order to move the torsional spring 180 out of the way of the locking member 176. FIG. 18 shows the torsional spring 180 engaged with the locking member 176, such that the safety latch is locked. FIG. 19 shows the rotatable member 168 rotated clockwise such that the torsional spring 180 is no longer engaged with the locking member 176, and the outer sleeve 48 is free to move away from the base 18.

Figure 20:
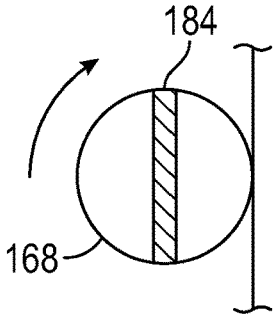
FIG. 20 is a side view of the rotatable member.
Figure 21:
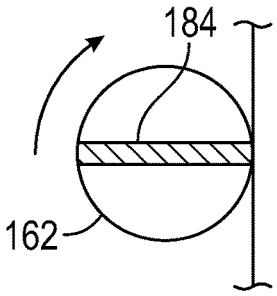
FIG. 21 is a side view of the rotatable member from FIG. 20, and an unlatched configuration.

FIG. 20 is side view of the rotatable member 168. In this view a handle 184 is shown on the rotatable member 168, that allows a user to hold and rotate the rotatable member 168. FIG. 21 shows the rotatable member from FIG. 20, rotated in the clockwise direction so that the safety latch is now unlocked. The force of the torsional spring 180 tends to keep the rotatable member in a locked position with respect to the locking member 176.

The disclosed container with safety-latch has many advantages. The latch will prevent children from opening the container, because of the difficulty of operating the latching system for children. Thus, the container can hold items that may be considered dangerous for children, such as medicines, cannabinoid products, including cannabis, and other items. Opening the container requires dexterity that small children may not have.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A container with a safety-latch, the container comprising:

a lid;

a base rotatably attached to the lid;

a lip located on the lid;

a base pin attached to the base;

an outer sleeve rotatable attached to the base pin;

a U-shaped pin rotatably attached to the outer sleeve, and configured to removably attach to the lip;

a post expending from the base;

an inner member located within the outer sleeve, the inner member elastically deformable;

a post hold located on the inner member, the post hole configured to have a diameter to allow the post hole to slide over the post;

a cut located between the post hole and the bottom of the inner member, wherein when the inner member is deformed, the cut opens widely to allow the post to slide easily out of the post hold and to allow the post to slide easily into the post hole;

a first cutout on the right side of the outer sleeve;

a second cutout on the left side of the outer sleeve;

wherein the outer sleeve and U-shaped pin are difficult for a child to manipulate in order to remove the U-shaped pin from the lip;

wherein the container is configured such that when the lid is locked onto the base, the post extends through the post hole; and wherein the first and second cutouts allow a user to squeeze the inner member in order to deform the inner member and allow the post hole and cut to open and allow the post to easily slide in and out of the post hole.

2. The container of claim 1, wherein the inner member further comprises an opening located in the inner member that allows the inner member to easily elastically deform.

3. The container of claim 1, wherein the post comprises:

a head; and a shaft attached to the head, where the shaft diameter is less than the head diameter.

4. The container of claim 3, wherein the head tapers from a first diameter to a second diameter, with the larger diameter abutting the shaft.

* * * * *